United States Patent [19]

Goodman

[11] 4,027,458

[45] June 7, 1977

[54] AUTOMATIC PACKAGING APPARATUS

[76] Inventor: James A. Goodman, 9347 Springfield, Evanston, Ill. 60022

[22] Filed: Dec. 22, 1975

[21] Appl. No.: 643,257

[52] U.S. Cl. ..... 53/55; 53/59 R; 53/126; 53/244; 53/251

[51] Int. Cl.² ..... B65B 57/06; B65B 57/12

[58] Field of Search ..... 53/55, 59 R, 244, 250, 53/251, 126; 198/69

[56] References Cited

UNITED STATES PATENTS

| | | | |
|---|---|---|---|
| 2,749,687 | 6/1956 | Imbs | 53/244 X |
| 3,492,779 | 2/1970 | Russell | 53/126 X |
| 3,710,543 | 1/1973 | Toss | 53/244 |
| 3,735,552 | 5/1973 | Derderian | 53/244 X |
| 3,815,321 | 6/1974 | Hartman | 53/244 X |

*Primary Examiner*—Travis S. McGehee

*Attorney, Agent, or Firm*—Irving Faber

[57] ABSTRACT

This invention relates to a new and useful apparatus for filling cartons with pre-packaged bags of a product from a Bag Form Fill and Seal Machine. The apparatus comprises, in combination, a horizontal feeder that transfers the bags to a vertical flite conveyor; said conveyor conveying the bags to a hopper having a trap door. A carton is positioned under the trap door of the hopper for receiving the bags. When a pre-set number of bags have passed through the hopper into the carton, the trap door closes. The carton, while it is being filled, is continually subjected to a series of impacts that enables the bags to lay flat within the carton. When the carton receives the pre-set number of bags, the impacting ceases and the carton is transferred to an output conveyor.

28 Claims, 19 Drawing Figures

82
84
68
106
42
56
48
72
36
24
150
25a
26a
26
34
58
60
64
50
52
54
78
86
90
92
94
95a
96
98
100
102
103
23
23w
32

AUTOMATIC PACKAGING APPARATUS

BACKGROUND OF INVENTION

There are many industries today that package food products, drug products, etc. into premeasured bags by means of a device called a Bag Form Fill and Seal Machine; said machines being readily available on the market and being commonly known as form fill and seal machines. However, a problem occurs when it comes time to package the bags from the form fill and seal machine to a carton. In most situations the loading of the carton is done by individuals who also count the bags as they are placing them into the carton. This means of filling a carton is both time consuming and expensive. Labor today is not only expensive but unreliable. In most situations the laborer places too many or too few bags into the carton which in turn increases costs and leads to problems with the user. Further, when the bags are packed into the cartons, they do not lay flat which necessitates the need for a larger carton to accommodate them; again increasing the cost. Also, bag damage is caused when the bags are placed into the carton in a hap-hazard manner, resulting in loss of product and added costs.

There is a great need for an apparatus that can effectively and efficiently take a pre-packaged commodity from a form fill and seal machine or other type machine and accurately and efficiently place a pre-set number of bags into a carton and then transfer the carton to an output terminal.

The most automated packing system known to me for this type of commodity is where the bags are automatically counted; however, the loading of bags into empty cartons is accomplished by laborers.

A major disadvantage with the existing types of packaging systems is the amount of floor space it takes. This disadvantage is eliminated by my invention. The floor space my invention requires is substantially reduced from the existing systems known to me.

SUMMARY OF INVENTION

This invention relates to a new and useful apparatus for packaging, into cartons, pre-packaged goods from a form fill and seal machine or other similar type device. The apparatus is very efficient in that it is able to take product from two form fill and seal machines and simultaneously fill cartons and then transfer the cartons from each carton filling system to a central output conveyor which transfers the filled cartons to an output terminal for sealing.

In the preferred embodiment there are two carton filling systems for each apparatus and each system comprises a horizontal feeder that takes the prepackaged bags to a vertical flite conveyor. The vertical flite conveyor moves the bags to a hopper that has a trap door. A carton is positioned, by means of an input conveyor system, under the trap door of the hopper for receiving the bags as they pass therethrough. The carton is continually subjected to an impact device that applies a series of alternate impacts upon opposite sides of the carton during the time the bags are being deposited therein. The impacting of the carton during the time the bags are being deposited therein enables the bags to lay relatively flat considerably reducing damage to them. Further, the impacting of the carton enables the bags to fit more compactly therein, resulting in a smaller carton being used. When a pre-set number of bags have been deposited within the carton, the trap door closes and the impactor is cut off enabling the carton to be transferred to an output conveyor. However, since there are two carton filling systems and one output conveyor, interlocking means are provided to sequence the transferring of the cartons to the output conveyor thereby inhibiting the possibility of two cartons being or attempted to be placed on the output conveyor simultaneously.

The apparatus, in comprising two carton filling systems, enables two different types of products having different bag sizes and/or shapes to be simultaneously packaged into different size cartons. Although I have described hereinabove an apparatus having two carton filling systems with a central output conveyor it is possible to have only one carton filling system with or without an output conveyor system for automatically filling product into a carton.

Accordingly, it is an object of this invention to provide an automatic packaging apparatus for taking the output from a form fill and seal machine or the like and place it into a carton.

Another object of the invention is to provide a dual system packing apparatus that can simultaneously fill two cartons and alternately transfer each of the filled cartons to a common output conveyor.

Another object of the invention is to provide a dual system packaging apparatus that can simultaneously fill two cartons of different sizes and of different products and transfer each of the filled cartons to a common output conveyor.

Another object of the invention is to use a smaller carton to package a pre-set number of bags as has heretofore not been possible.

Another object of the invention is to provide an automatic packaging apparatus having a dual packing system that has means to equally distribute the bags deposited in the cartons.

Still a further object of the invention is to provide an automatic packaging apparatus having a dual packing system that has provision for moving empty cartons into a position for receiving a pre-set number of bags.

It is still a further object of the invention to provide an automatic packaging apparatus having a dual packing system that will substantially reduce the number of laborers required to package bags from a form fill and seal machines and the like.

It is still a further object of the invention to provide a compact automatic packaging apparatus that will use a minimum amount of space.

IN THE DRAWINGS

DESCRIPTION OF PREFERRED EMBODIMENT

The preferred embodiment illustrated is not intended to be exhaustive or to limit the invention to the precise form disclosed. It is chosen and described in order to best explain the principles of the invention and its application and practical use to thereby enable others skilled in the art to best utilize the invention.

Figure 1:
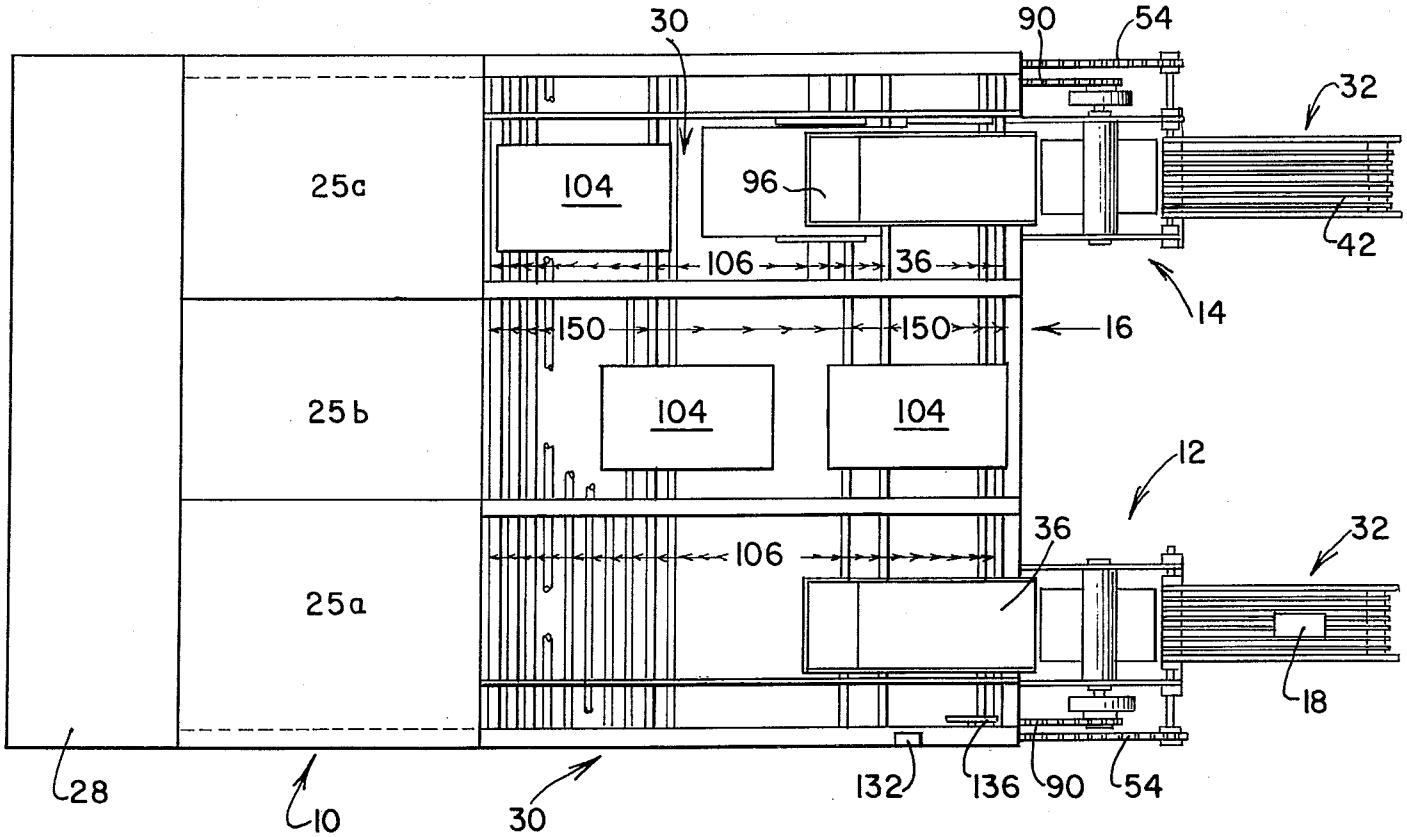
FIG. 1 illustrates a top plan view of the apparatus embodied by the invention.

FIG. 1 illustrates a top plan view of the apparatus embodied by this invention and is designated by the numberal 10. The apparatus 10 comprises two packaging systems 12 and 14 that feed a common output conveyor system 16. Each packing system 12 and 14 is identical in parts and operation. The following description and discussion relative to one packing system is applicable to the other and the numerical designations applicable to one are applicable to the other.

Figure 2:
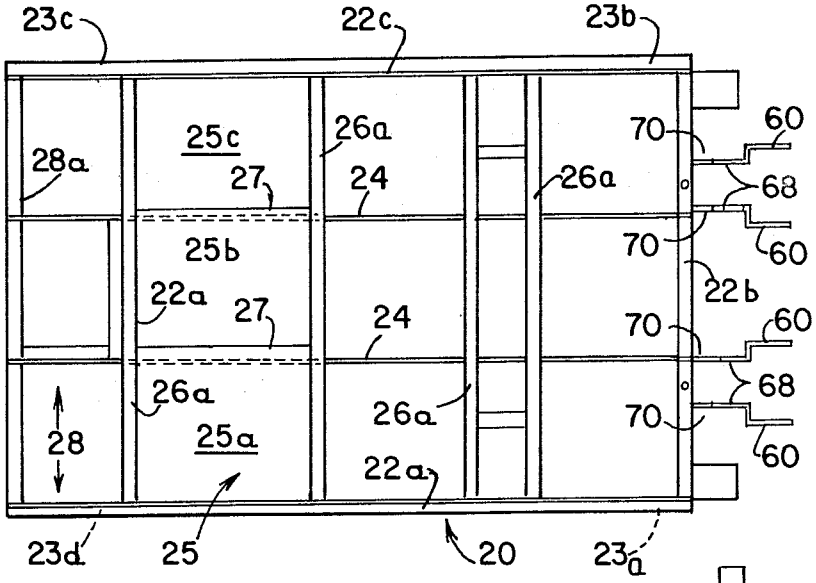
FIG. 2 is a top plan view of the structural frame of the apparatus embodied by the invention.
Figure 3:
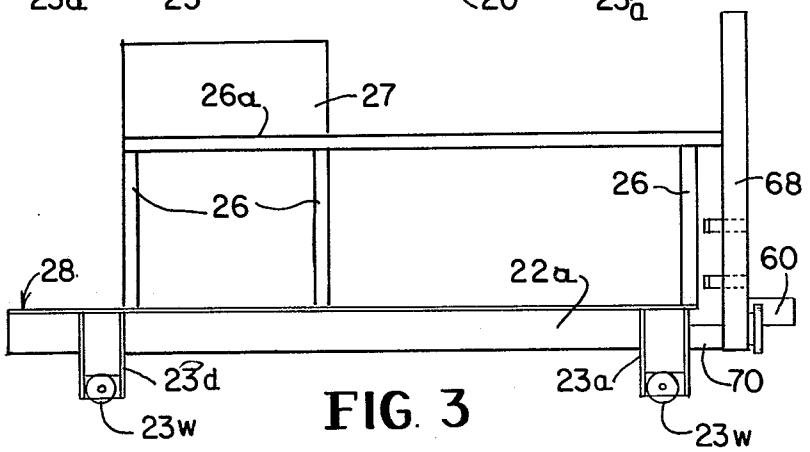
FIG. 3 is a side elevational view of the structural frame of the apparatus embodied by the invention.

The packaging systems 12 and 14 and the output conveyor system are coupled to a frame 20; said frame being illustrated in FIGS. 2 and 3.

The frame 20 is basically rectangular in shape and of steel stock. The frame is comprised of sides 22*a*, *b*, *c*, *d*; the respective corners formed by said sides being welded together by means well known in the art. At each corner of the frame 20 is a leg 23*a* through *d* attached thereto by means of welding or other means well known in the art. Each of the legs 23 has means for coupling thereto wheels 23*w* in such a manner that the frame rests upon said wheels. A pair of longitudinal bars 24 divide the frame 20 into three sections, the outer sections being for the packaging systems 12 and 14 and the center section being for the output conveyor system 16.

A platform 25 for storing empty flat cartons and a taping device is provided over the packing systems 12 and 14 and the output conveyor system 16. The platform 25 is coupled to the frame 20 by means of vertical support members 26 and horizontal support members 26*a*. A pair of separators 27 separate the platform 25 into three compartments, 25*a*, 25*b*, 25*c*; compartments 25*a* and 25*c* being for carton storage while compartment 25*b* is used for a taping device, not shown, for sealing the cartons as they come off the output conveyor 16.

A work ledge 28 is formed by side members 22*a*, 22*c* that extend beyond the legs 23*c*, 23*d* and horizontal ledge support member 28*a*. The ledge is used for supporting the cartons as they come off the output conveyor 16. It is understood that the frame 20 may be of a geometrical configuration other than rectangular and may be of a material other than steel without departing from the spirit and scope of the invention. It is further understood that the platform 25 and work ledge 28 may be deleted without restricting the operation of the apparatus or departing from the spirit and scope of the invention.

Each packaging system 12 and 14 receives pre-packaged bags of product 18 from a device known as a Bag Form Fill and Seal Machine, not illustrated; said machine being commonly known as a form fill and seal machine. The form fill and seal machines are readily available in the market place for packaging products such as food, drugs, hardware, and the like into pre-set bags containing a particular weight or quantity of product. The particular pre-packaged product that I have used for this embodiment is coffee. However, any type of pre-packaged product capable of eminating from a form fill and seal machine or other type machine can be used with my invention without departing from the spirit and scope of the invention. Further, it is possible to feed any solid product directly to each of the packaging systems without the necessity of a form fill and seal machine or other similar type machine.

Each packaging system 12 and 14 is comprised in combination of an input conveyor system 30, a horizontal feeder system 32, a vertical flite conveyor system 34, a hopper 36, an impact mechanism 38 and a plow or transfer mechanism 40.

Figure 4:
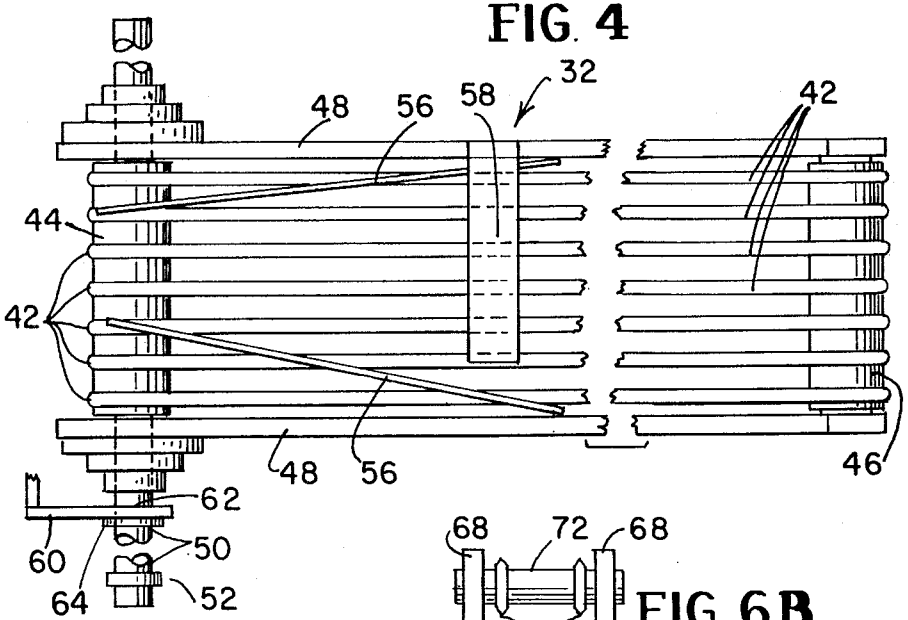
FIG. 4 is a top plan view of the horizontal feeder system embodied by the invention.
Figure 6B:
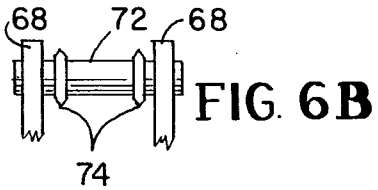
FIG. 6B is a partial front view of the guide shaft and sprockets of the vertical flite conveyor embodied by the invention.
Figure 6A:
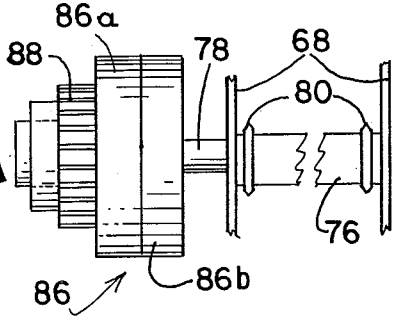
FIG. 6A is a cut away front view of the drive shaft and the electrically operated clutch of the vertical flite conveyor embodied by the invention.
Figures 5, 6, 7:
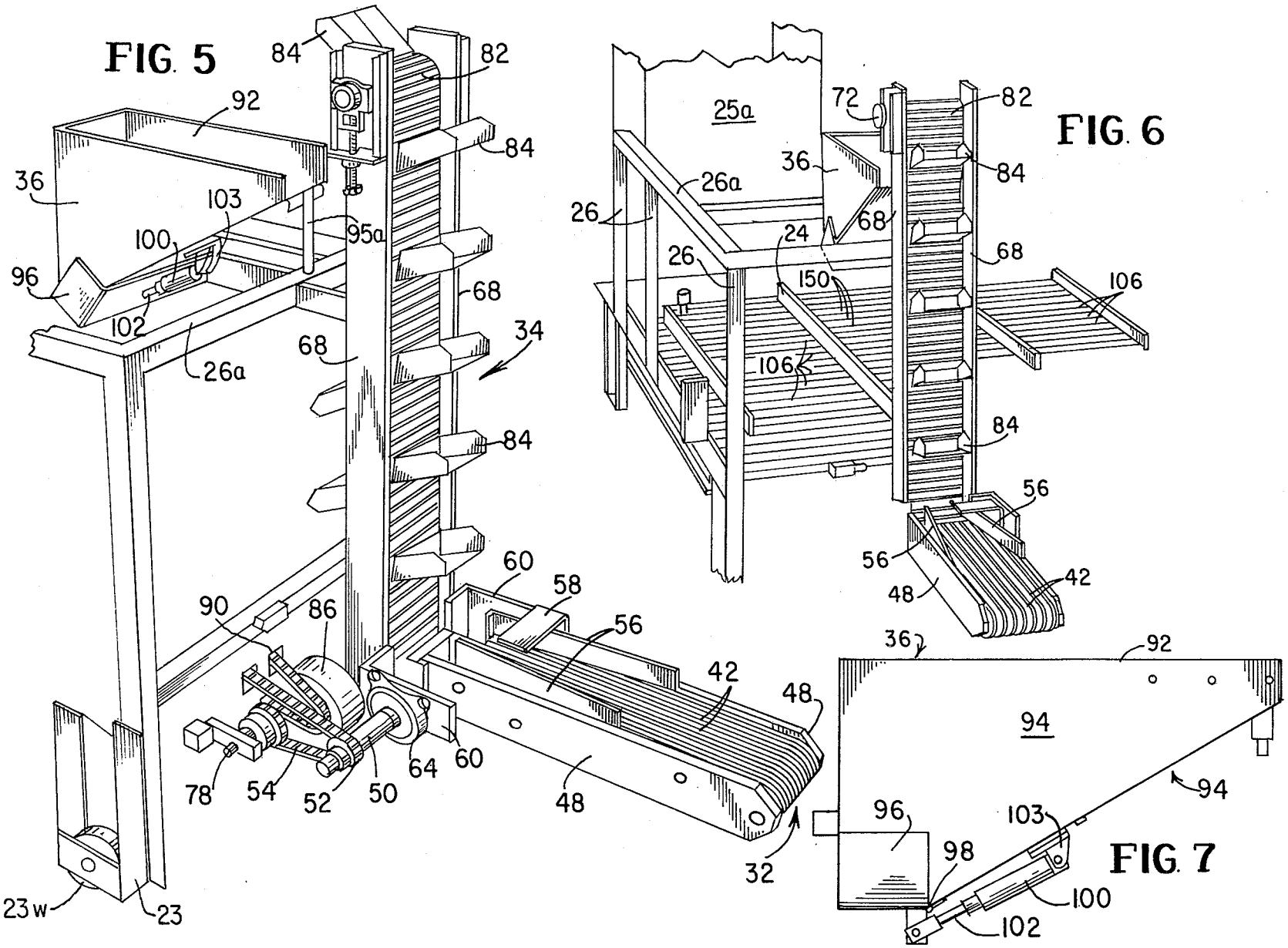
FIG. 5 is a view, in perspective, of the horizontal feeder system, the vertical flite conveyor system and the hopper, all of which are embodied by the invention.
FIG. 6 is a partial perspective view of the vertical flite conveyor emmbodied by the invention.
FIG. 7 is a side elevational view of the hopper embodied by the invention.

The pre-packaged bags of product 18 are deposited onto the horizontal feeder system 32; said feeder system being positioned relative to the bag form fill and seal machine so as to receive said bags of product as they leave said device. The horizontal feeder system 32, as illustrated in FIGS. 4 and 5 comprises a plurality of conveyor type ribbons 42 coupled to a drive roller 44 and a guide roller 46. The ribbons 42 are of a plastic composition that is readily available in the market. The conveyor ribbons 42 extend between and snuggly around the rollers 44 and 46. The ribbons 42 may be of a composition other than plastic or may be replaced by a conveyor belt, not shown, but well known in the art without departing from the spirit and scope of the invention. I have chosen the ribbon type conveying system because of the granualar nature of the bagged product; namely, coffee. The use of the ribbons 42 enables loose product from broken bags to fall to the ground. The drive roller 44 and the guide roller 46 are interposed between and coupled to a pair of side plates 48 by means well known in the art and in such a manner as to enable said rollers to rotate therebetween. The drive roller has attached thereto a shaft 50 having a drive sprocket 52. Drive means 54 are coupled to the drive sprocket 52.

The drive means 54 is a sprocket chain coupled to a motor, not illustrated. The driving means 54, via the motor, imparts a rotary motion to the shaft 50 which in turn imparts a rotary motion to the drive roller 44. The rotation of the drive roller 44 causes the plurality of conveyor ribbons 42 to rotate about the drive roller 44 and the guide roller 46 conveying the bags 18 from the bag former to the vertical flite conveyor 34.

A pair of guide plates 56 and an electric eye 58 are coupled to the side plates 48 by means well known in the art. The guide plates 56 direct the bags 18 to pass under the electric eye 58. The electric eye 58 is part of a counter, not illustrated, but well known in the art, for counting units to a pre-set number and then resetting itself. The counter will initiate an electrical signal when the pre-set number is reached. The electric eye 58 initiates a signal to the counter each time a bag 18 passes thereunder. There are many types of counters available in the market that can be used for counting the bags 18 without departing from the spirit and scope of the invention.

The horizontal feeder system 32 is coupled to the vertical flite conveyor 34 by means of a pair of connecting plates 60, one end of which is welded to the vertical flite conveyor 34. The other end of the connecting plates 60 each have an aperture or slot 62 for receiving the extension shaft 50. A bearing retainer 64 is coaxial with the aperture 62 and is attached to each of the plates 60 by means of bolts and nuts not shown; the shaft 50 passing through said bearing retainer. The bearing retainer 64 is of a type well known in the art and readily available in the market for enabling a shaft to freely rotate therein.

The vertical flite conveyor system 34 is illustrated in FIGS. 5, 6, 6A, and 6B and comprises a pair of vertical side plates 68 positioned perpendicular to the frame 20 and coupled thereto by means of extension plates 70. The vertical sides 68 are parallel to and positioned opposite each other. The extension plates 70 have one end thereof welded to side **22*b* of the frame 20 and the other side thereof welded to the vertical side plate 68. A guide shaft 72 is positioned between the vertical side plates 68 adjacent the upper end thereof and coupled thereto in a manner well known in the art to enable said shaft to rotate therebetween. A pair of sprockets 74 are positioned on and coupled to the shaft 72.**

A drive shaft 78 is positioned between the vertical side plates 68 adjacent the lower end thereof and coupled thereto in a manner well known in the art enabling said drive shaft to rotate therebetween. The guide shaft 72 and the drive shaft 78 are parallel and opposite each other. A pair of sprockets 80 is positioned on and coupled to the drive shaft 78; the sprockets 74 and 80 being parallel and opposite each other.

Rotating means such as a vertical flite chain 82 is positioned between the vertical side plates 68 extending between and around the guide shaft 72 and the drive shaft 78; said means mattingly engaging the pair of sprockets 74 and 80. A plurality of flites 84 are equally spaced and coupled to the flite chains 82 by means well known in the art.

The shaft 78 passes through and is coupled to an electrically actuated clutch 86 by means well known in the art. The clutch 86 is a standard type electrically operated clutch and is readily available in the market having an armature section **86*a* and a rotor section 86*b*. A sprocket 88 is coupled to the clutch armature 86*a*, by means well known in the art, for receiving driving means 90; said driving means being a sprocket drive chain coupled to a motor, said motor not being illustrated. The driving means 90, via the motor imparts a rotary motion to the clutch armature 86*a* which in turn causes the drive shaft 78 to rotate via the clutch rotor 86*b* when the clutch armature 86*a* is magnetically engaged with the clutch rotor 86*b;* the drive shaft 78 being coupled to the clutch rotor 86*b*. Rotation of the drive shaft 78 imparts a vertical motion to the flites 84 by means of the vertical flite chains 82. The same motor is used to impart power to drive means 54 and drive means 90.**

The horizontal feeder system 32 is positioned relative to the vertical flite conveyor 34 to enable the flites 84 to pick up the bags 18 from the conveyor ribbons 42 as they rotate about and off the conveyor belts 42 of the drive roller 44 and carry them vertically to the hopper 36. It is important that a flite 84 is available for picking off a bag 18 as it comes over the drive roller 44. In order to achieve this result a standard control circuitry, not illustrated is used. The control circuitry is well known in the art and extends between the electric eye 58 of the counter and electrically operated clutch 86. When the electric eye 58 does not send a bag 18 passing thereunder an electrical signal is transmitted to the clutch 86 which in turn disengages the clutch armature **86*a* from the clutch rotor 86*b* stopping the vertical flite conveyor 34. The rotor 86*b* and shaft 78 is magnetically re-engaged with the drive armature 86*a* when the electric eye 58 senses a bag 18 passing thereunder, thereby causing the flites 84 to move again. The use of standard control circuitry to magnetically engage and disengage the electrically actuated clutch 86 based upon signals from the electric eye 58 enables the vertical flite conveyor to synchronize itself with the movement of bags 18 on the horizontal feeder system 32. This insures there will be a flite 84 ready to receive a bag 18 as it comes off of the conveyor or ribbons 42 as said ribbons rotate about the drive roller 44.**

Figure 8:
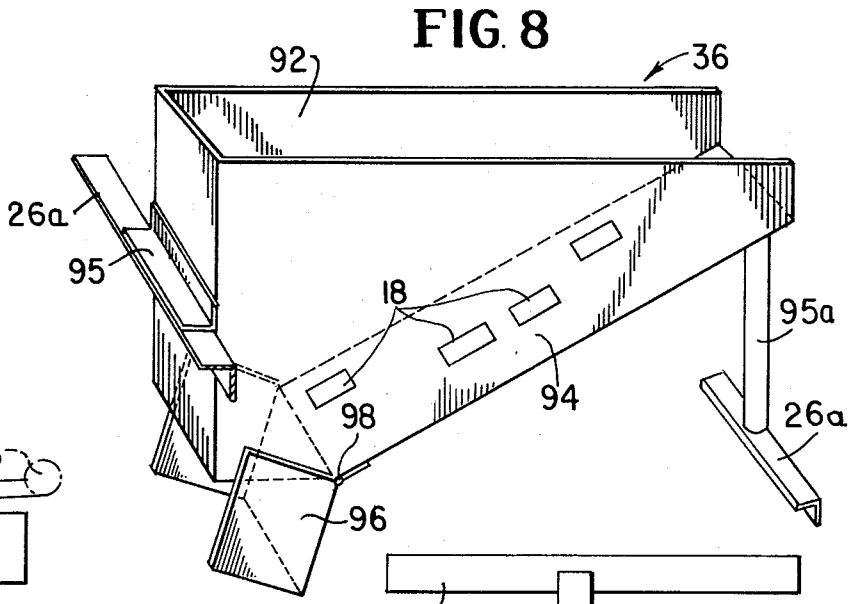
FIG. 8 is a view, in perspective, of the hopper embodied by the invention.

The hopper 36, as illustrated in FIGS. 5, 7, and 8 is of a modified funnel shape made of stainless steel having an upper end 92 and a lower end 94. The upper end 92 is open for receiving the bags 18; the remaining surfaces of the hopper being closed. The hopper 36 is coupled to the frame 20 by hopper supporting members **95, 95*a* attached to the frame members 26*a* by means well known in the art. The hopper 36 is positioned relative to the vertical flite conveyor 34 so that its open end 92 is positioned slightly below the guide roller 72 enabling the hopper to receive the bags 18. The lower end 94 of the hopper 36 has a trap door 96; said trap door being hinged to the hopper structure 36 by hinge means 98. There are many means well known in the art for hinging the trap door 96 to the hopper structure 36 and any one may be used without departing from the spirit and scope of this invention. The one illustrated in FIG. 8 is a piano-type hinge well known in the art. The trap door 96 is opened and closed by means of an air cylinder 100 having a piston 102. The cylinder 100 is coupled to the lower end 94 of the hopper 36 by means of a cylinder bracket 103; the piston 102 being coupled to the trap door 96. The trap door 96 is normally in the open position. The bags 18 are flipped into the open end 92 of the hopper 36 as each flite 84 moves around the guide roller 72, the bags falling through the normally open door 96 to a carton 104** positioned thereunder.

The air cylinder 100 is actuated, closing the trap door 96 when the counter, not shown, reaches its pre-set count; the counter accumulating the total number of bags 18 passing under the electric eye 58. When the pre-set count is achieved the counter resets itself. The closing of the door 96 does not stop the flow of bags 18 to the hopper 36 from the vertical flite conveyor 34.

The bags 18 will accumulate in the hopper until the air cylinder 100 is actuated opening the trap door 96. The air cylinder 100 is actuated, opening the door 96 when an empty carton 104 replaces the full carton under the hopper 36; the accumulated bags 18 within the hopper falling into the empty carton. The process of replacing the full carton with an empty carton will be discussed hereinafter.

The control circuitry between the counter, the electric eye 58, and the air cylinder 100 is well known in the art and is not shown.

The hopper 36 may be of any size and/or geometrical configuration other than illustrated or made from any of the many materials known in the art without departing from the spirit and scope of the invention.

Figure 10:
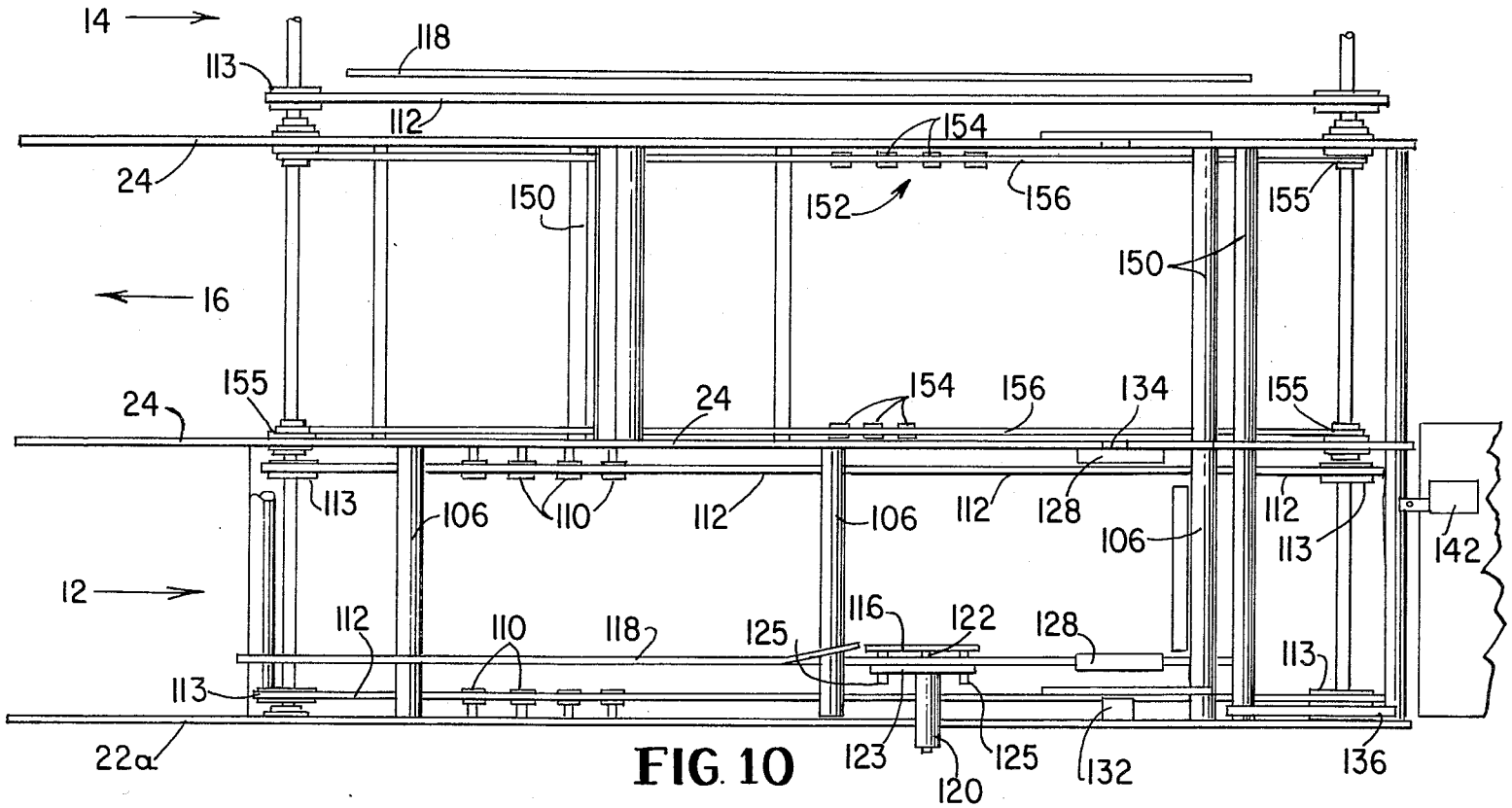
FIG. 10 is a top plan view of the input conveyor system and output conveyor system as embodied by the invention.
Figure 9:
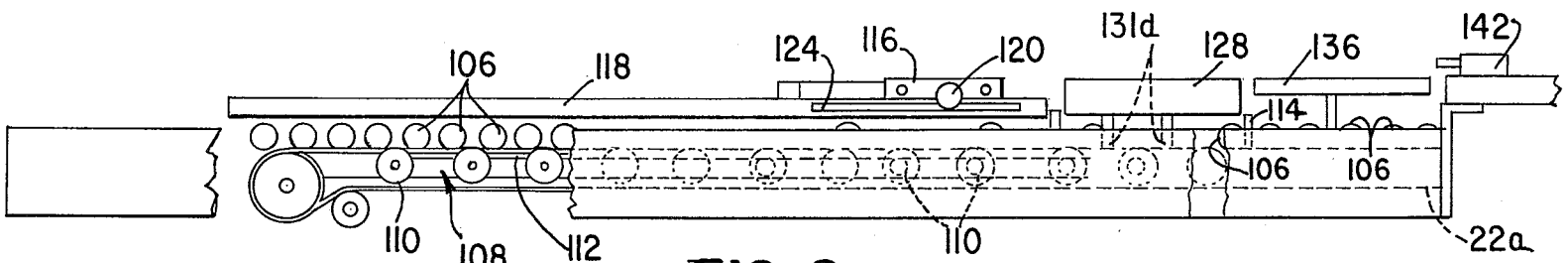
FIG. 9 is a side elevational view of the input conveyor system as embodied by the invention.

The cartons 104 are conveyed to a position under the trap door 96 of the hopper 36 by means of the input conveyor system 30 illustrated in FIGS. 9 and 10.

The input conveyor system 30 comprises a plurality of rollers 106 that are positioned between and coupled to one side of the frame 22*a* and one of the pair of longitudinal bars 24 in a manner well known in the art to enable the rollers to rotate therebetween. A drive train 108 imparts a rotary motion to the rollers 106. The drive train 108 comprises a plurality of drive wheels 110 that are positioned below and between the rollers 106 so as to frictionally engage said rollers via a drive band 112; said drive wheels being coupled to the frame sides 22*a*, 22*c* and the longitudinal bars 24 in a manner well known in the art enabling said drive wheels to rotate. A pair of guide wheels 113 are positioned at each end of the drive train 108; said wheels being coupled to the side frame 22*a* and 22*c* of the frame 20 and the bars 24 in a manner well known in the art to enable them to rotate. The drive band 112 extends over and around the drive wheels 110 and guide wheels 113 frictionally engaging said wheels and the rollers 106. The drive band 112 is coupled to the same motor, not shown, by means well known in the art that provides power to drive means 54 and 90. When the drive band 112 is placed in motion via the motor, the drive wheels 110 and the rollers 106 that frictionally engage said band rotate moving any cartons thereon along said rollers 106 toward the hopper 36.

The input conveyor system 30 further comprises a full carton stop 114, an empty carton stop 116 and a guide rail 118. The guide rail 18 is positioned parallel to the frame side 22*a* and one of the pair of longitudinal bars 24 and extends substantially the length of the plurality of rollers 106. The rail 118 is coupled to the frame 20 by means well known in the art and is positioned slightly above the rollers 106 so as not to inhibit their rotation. Further, the rail guide 118 is adjustable by means well known in the art over the width between the frame side 22*a* and the bar 24. The adjustable rail 118 enables the input conveyor system 30 to accommodate cartons 104 of many sizes.

The empty carton stop 116 is coupled to the guide rail 118 and is positioned relative thereto to inhibit the further movement of cartons between the guide rail 118 and the bar 24. An air cylinder 120 having a piston 122 is coupled to the guide rail 118 by means of cylinder mounting plate 123. The air cylinder piston 122 is coupled to the stop 116. The air cylinder 120 in its open position moves the stop 116 into the path of a carton that is traversing the rollers 106. The air cylinder 120 in the closed position moves the stop 116 out of the path of the carton thereby enabling the carton to proceed along the rollers 106. The stop 116 and the air cylinder 120 are adjustable longitudinally along a slot 124 in the guide rail 118. A pair of shafts 125 are coupled to the stop 116 and extend through apertures in the mounting plate 123.

Figure 11:
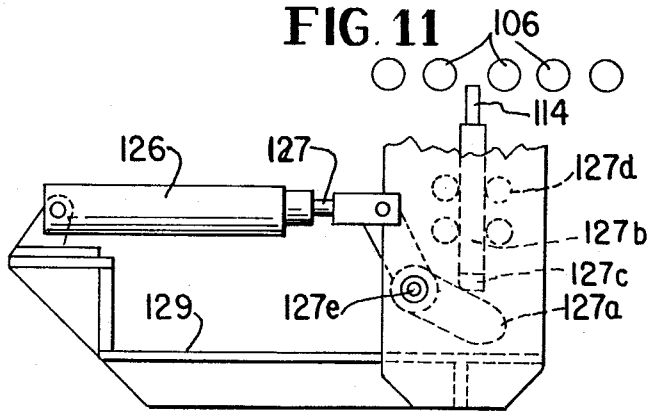
FIG. 11 is a side elevational view of the full carton stop embodied by the invention.
Figure 11A:
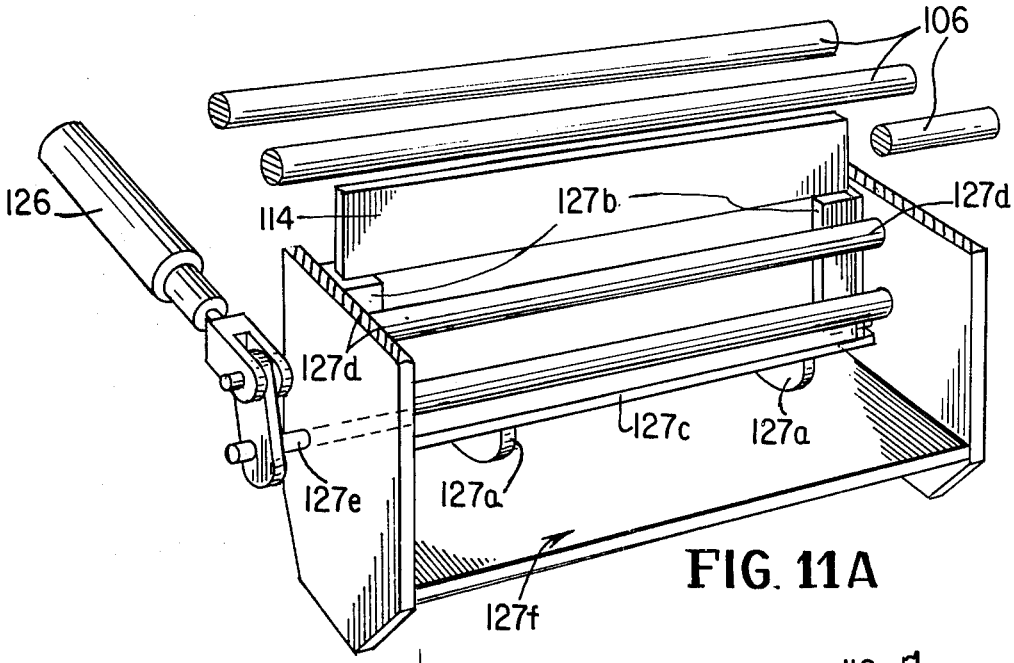
FIG. 11A is a perspective view of the full carton stop embodied by the invention.

The full carton stop 114 illustrated in FIGS. 11 and 11A is a flat bar positioned between a pair of the plurality of rollers 106. The stop 114 is positioned to stop a carton 104 beneath the trap door 96 of the hopper 36. An air cylinder 126 is coupled to the stop 114 by cylinder arm 127; the cylinder being coupled to the frame 20 by means well known in the art via a support bracket 129. The air cylinder 126 in its closed position enables the stop 114 to rise above the rollers 106 stopping a carton 104 under the hopper 36 via cylinder arm 127 and lift cams 127*a*. When the air cylinder 126 is in its open position, the stop 114 is retracted below the rollers 106.

The stop 114 is coupled to the lift cam 127*a* by means of a pair of lift bars 127*b* and a tie bar 127*c;* said lift bars being positioned between a plurality of cam followers 127*d*. The lift cams 127*a* are coupled to a shaft 127*e* which is coupled to the cylinder arm 127 by means well known in the art. The guide bars 127*b* and plurality of cam followers 127*d* are coupled to a cam follower support structure 127*f* which is coupled to the frame 20 by means well known in the art.

The cam followers 127*d* and guide bars 127*b* are coupled to the cam follower support structure by means well known in the art enabling the guide bars to move simultaneously vertically up or down between the cam followers 127*d*. The tie bar 127*c* rests upon the lift cams 127*a*. When the cylinder arm or piston 127 moves either in or out, the lift cams 127 are partially rotated moving the tie bar 127*c* and stop 114 via lift bars 127*b* up or down between a pair of the rollers 106.

Figure 13:
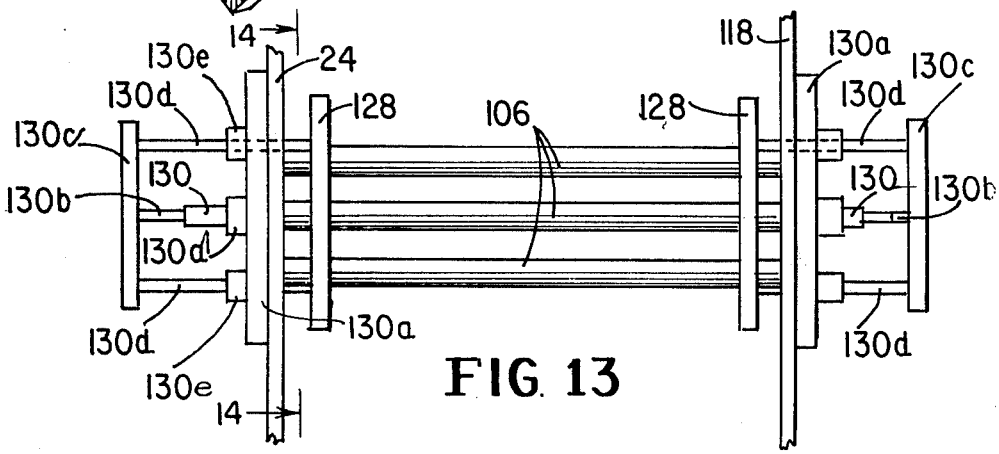
FIG. 13 is a top view of the impact mechanism embodied by the invention.
Figure 14:
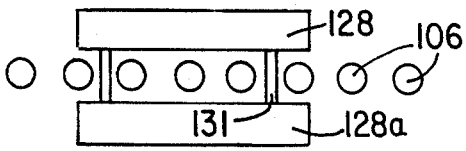
FIG. 14 is a side elevational view of the impact mechanism embodied by the invention.
Figure 15:
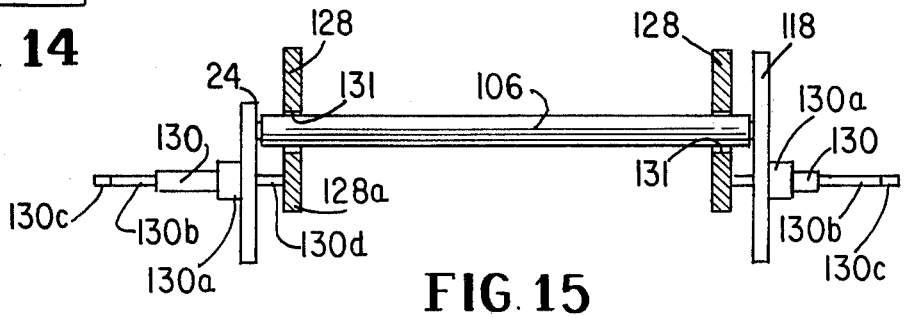
FIG. 15 is a front elevational view of the impact mechanism embodied by the invention.

The impact mechanism or impactor 38 illustrated in FIGS. 13, 14, and 15 is comprised of a pair of parallel impact plates 128 each coupled to an air cylinder 130. The parallel plates are positioned between the full carton stop 114 and the empty carton stop 116 slightly above the rollers 106. One of the pair of plates 128 is parallel and adjacent to the longitudinal bar 24 while the other plate is adjacent to and parallel the guide rail 118; this latter plate being adjustable with the guide rail. One of the pair of air cylinders 130 is coupled to a mounting plate 130*a* that is coupled to the frame 20 via the guide rail 118 and the other to the bar 24 by means well known in the art. Each cylinder 130 has a piston 130*b* coupled to a tie bar 130*c*. A pair of shafts 130*d* extend between a tie plate 128*a* and the tie bar 130*c* through a bushing 130*e*. A pair of rods 131 couple the impact plate 128 to the tie plate 128*a*. When the piston 130*b* is activated it moves the tie bar 130*c* either in or out which in turn moves the shafts 130*d* and the impact plate 128 via tie plate 128*a*. The impact plate 128 is positioned slightly above the rollers 106 while the air cylinder 130, tie bar 130*c*, tie plate 128*a*, bushings and shafts are below the rollers 106. The distance between the plates 128 is slightly wider than the width of the carton 104 traversing the rollers 106. An electric eye 132 coupled to the frame 20 starts the air cylinders 130 operating when a carton 104 breaks the beam of the electric eye 132 to the reflector 134. A cam programer, not shown, which is well known in the art and readily available is electrically coupled to the air cylinders 130. The cam programer enables the plates 128 to alternate impacts upon the carton 104, each impact by a plate 128 forces the carton 104 to the opposite plate 28.

The carton 104 is subjected to continuous alternate impacts by the plates 128 as the bags 18 are being deposited into said carton via the hopper 36. It is the continuous impacting of the carton 104 while it is receiving the bags 18 that causes said bags to lay flat within the carton.

Figure 12A:
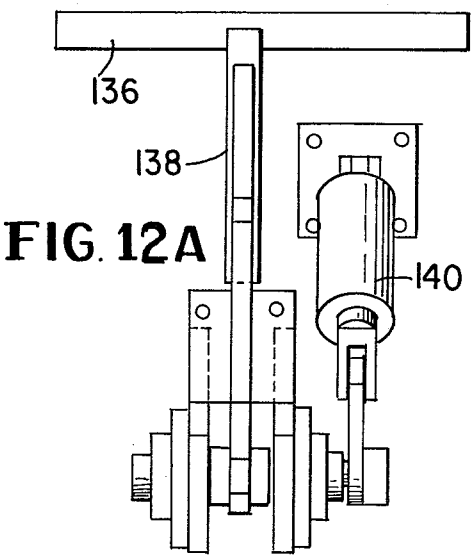
FIG. 12A is a front elevational view of the plow mechanism incorporated by the invention.
Figure 12:
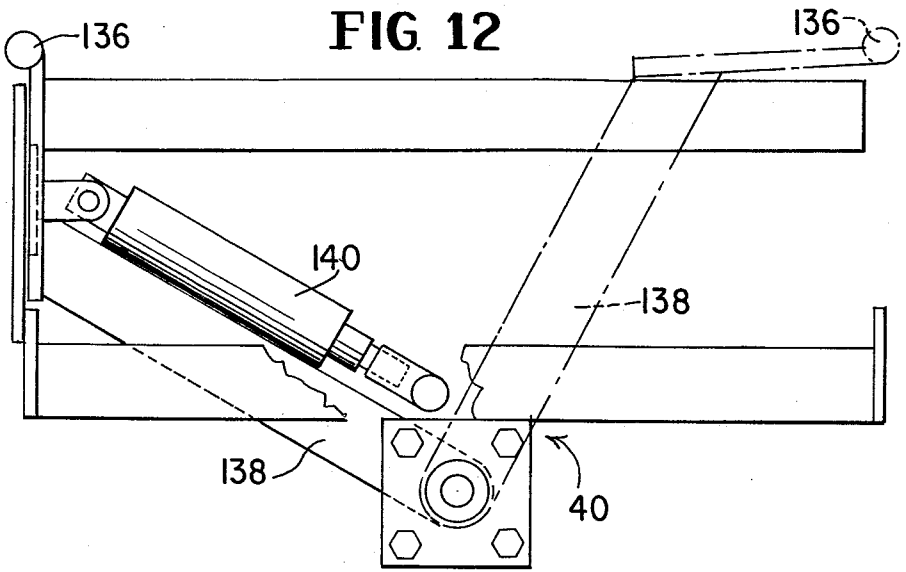
FIG. 12 is a side elevational view of the plow mechanism incorporated by the invention.

The plow or transfer mechanism 40 illustrated in FIGS. 12, 12A comprises a plow bar 136 that lies slightly above and perpendicular to the rollers 106 and is adjacent to and parallel to the frame side 22*a*. FIG. 12 illustrates the plow bar 136 in its closed and open positions. A connecting rod 138 couples the plow bar 136 to an air cylinder 140; said connecting rod being positioned between a pair of rollers 106. The air cylinder 140 is coupled to the frame 20 in a manner well known in the art that enables the plow bar 136 to be positioned slightly above the rollers 106.

A limitswitch 142 is positioned on the frame side 22*b* and positioned such that a carton 104 will contact it after it has been released by the full carton stop 114. When the limitswitch 142 is actuated by the carton 104 it in turn actuates the cylinder 140 which raises the plow bar 136 in such a manner as to move the carton to the output conveyor system 16.

The output conveyor system 16 comprises a plurality of rollers 150 that are positioned between and coupled to the bars 24 in a manner well known in the art to enable said rollers to rotate therebetween. Motion is imparted to the plurality of output rollers 150 by drive means 152.

The drive means 152 comprises a plurality of drive wheels 154 and guide wheels 155 that are positioned between and slightly below the rollers 150. A drive band 156 is positioned over the plurality drive wheels 154 and guide wheels 155 wherein said band frictionally engages the wheels 154 and the plurality of rollers 150. The drive band 156 is coupled to a motor, not shown, that imparts motion to the drive band and in turn imparts a rotary motion to the drive wheels 154 and the plurality of rollers 150.

In operation, bags of product 18 are individually deposited onto the horizontal feeder system 32 by a bag forming machine or the like. The bag is conveyed by means of the conveyor ribbons 42 to the vertical flite conveyor 34 while a flite 84 receives the bag 18 as it moves over the drive roller 44.

The vertical flite conveyor 34 takes the bag 18 and moves it in a vertical direction to the hopper 36, where said bag is deposited. The hopper 36 has a trap door 96 that is in the open position enabling the bags 18 to fall through to the carton 104 that is positioned below the hopper 36.

The electric eye 58 sends an impulse to the counter, not shown. When the counter reaches a pre-set number, an electrical signal is generated, the counter is reset and the counting of bags starts again. The counter is initially adjusted to enable the count to begin when the first bag enters the hopper from the vertical flite conveyor.

Four things occur simultaneously upon a signal being generated by the counter. The first is the trap door 96 of the hopper 36 closes inhibiting any further bags 18 from passing into the carton 104 via the horizontal connveyor system 32 and vertical flite conveyor 34 and the bags will collect there until the trap door 96 opens enabling said bags to be deposited into a new empty carton waiting thereunder. The second simultaneously act that occurs is the full carton stop 114 is actuated via air cylinder 126 lowering said stop below the input conveyor rollers 106. This enables the carton 104 directly under the hopper 36 to continue along the input conveyor rollers 106 until it activates the limit-switch 142 which in turn activates air cylinder 140 that moves the plow bar 136 into contact with the carton transferring it to the output conveyor system 16. The third simultaneous act that occurs is the retraction of the empty carton stop 116 enabling another empty carton to continue along the input conveyor rollers 106 until it breaks the electric eye beam generated by the electric eye 132. The breaking of the electric eye beam triggers air cylinder 126 that moves the full carton stop above the rollers 106 and causes the empty carton stop 116 via air cylinder 120 to move in stopping the flow of empty cartons. This action causes a new empty carton 104 to be positioned directly under the trap door 96 of the hopper 36 for receiving bags 18. The fourth simultaneous act that occurs is the impact mechanism 38 is deactivated. The impact mechanism 38 is re-activated when the empty carton 104 breaks the electric eye beam generated by the electric eye 132; this also activates air cylinder 100, opening the trap door 96 of the hopper 36. There is a time delay to enable the empty carton 104 to position itself under said trap door before it opens. The aforesaid cycle will repeat itself each time the counter reaches its pre-set number.

I have incorporated the electrical cam programer, not shown, that programs alternate impacts of the carton 104 by the impact plates 128 to also program the plow mechanism 40 of each of the input systems 12 and 14. The cam programer will enable the carton that first contacts the limit-switch 142 to be transferred to the output conveyor system 16, then the next and so on. The plow or transfer mechanism 40 of either input system will not operate unless a carton 104 contacts the limit-switch 142. There are many systems well known in the art that can be used to interlock the plow mechanism 40 of each packaging system 12, 14 to inhibit simultaneous activation thereof without departing from the spirit and scope of the invention.

The cartons 104 that have been transferred to the output conveyor system 16 from each of the input systems 12 and 14 are conveyed via the output rollers 150 to the work ledge 28 where it is received by a person who tapes the carton 104 and removes it from the ledge.

The preferred embodiment heretofore described is directed to an apparatus 10 having two carton filling systems 12 and 14 with a common output conveyor system 16. It should be understood that the apparatus 10 may comprise one carton filling system 12 and the output conveyor system 16 without departing from the spirit and scope of the invention. The operation of the apparatus 10 would be the same using one or two carton filling systems.

It is further understood that the automatic packaging system designated as the apparatus 10 may be comprised of the horizontal feeder system 32, the vertical flite conveyor system 34 and the hopper 36. In this configuration it would be necessary to have someone place the empty carton 104 under the hopper 36 and to remove it when it is full. In operation, the bags 18 would be deposited onto the horizontal feeder system 32 and conveyed to the hopper 36 via the vertical flite conveyor 34 as heretofore described.

It is believed that the invention has been described in such detail as to enable those skilled in the art to understand the same, and it will be appreciated that variations may be made without departing from the spirit and scope of the invention.

What is described to secure by letters patent in the United States is:

1. An automatic packaging apparatus for packaging a product into a container, said apparatus comprising:

a horizontal feeder system for conveying a product thereon;

a vertical flite conveyor system coupled to the horizontal feeder system and positioned relative thereto for receiving the product therefrom;

a hopper coupled to the vertical flite conveyor and positioned relative thereto for receiving the product therefrom, the product being deposited into the container via said hopper;

an input conveyor system coupled to the vertical flite conveyor system and positioned so as to enable a container traversing said input conveyor system to be positioned under the hopper; and electrical synchronizing means coupled to the vertical flite conveyor system and the horizontal feeder system enabling the synchronization of product flowing from the horizontal feeder system to the vertical flite conveyor system;

wherein the product arrives at the vertical flite conveyor system at a time when the vertical flite conveyor system is in a position to carry the product from the horizontal feeder system into the hopper.

2. An automatic packaging apparatus as defined in claim 1, said apparatus further comprising:

an output conveyor system adjacent and coupled to the input conveyor system.

3. An automatic packaging apparatus as defined in claim 2, said apparatus further comprising:

an impact mechanism coupled to the input conveyor system.

4. An automatic packaging apparatus as defined in claim 3, wherein said apparatus further comprises:

a transfer mechanism coupled to the input conveyor system wherein said transfer mechanism enables a carton to be transferred from the input conveyor system to the output conveyor system.

5. An automatic packaging apparatus as defined in claim 4, wherein said horizontal feeder system comprises:

a drive roller;

a guide roller positioned opposite and parallel to said drive roller;

a pair of side plates positioned parallel to and opposite each other, said plates being spaced from each other to enable said drive roller and guide to be positioned therebetween and coupled thereto to enable said drive roller and dummy roller to rotate therebetween.

6. An automatic packaging apparatus as defined in claim 5 wherein said vertical flite conveyor system comprises:

a pair of vertical sides plates coupled to the horizontal feeder system, a drive roller positioned between and coupled to the vertical side plates in such a manner as to enable said roller to rotate therebetween;

a guide roller positioned opposite said drive roller and coupled to the vertical side plates in such a manner as to enable said roller to rotate therebetween;

rotating means coupled to and extending between and around the drive and guide rollers and positioned between said vertical side plates; and a plurality of flites coupled to the rotating means wherein said flites receive the product from the horizontal feeder system and convey it to the hopper.

7. An automatic packaging apparatus as defined in claim 6 wherein said hopper comprises:

an upper end, said upper end being open and positioned adjacent to the vertical flite conveyor for receiving the product.

a lower end opposite the upper end and structurally coupled thereto;

a trap door coupled to the lower end; and means coupled to said trap door enabling it to open and close.

8. An automatic packaging apparatus as defined in claim 7 wherein said input conveyor system comprises:

a frame;

a plurality of rollers positioned between and coupled to the frame in a manner enabling said rollers to rotate; and a drive train coupled to said frame and positioned adjacent to and frictionally engaging said rollers wherein said drive train will impart a rotary motion to the rollers.

9. An automatic packaging apparatus as defined in claim 8 wherein said input conveyor system further comprises a full carton stop coupled to the frame and positioned between a pair of the plurality of rollers.

10. An automatic packaging apparatus as defined in claim 9 wherein said input conveyor system further comprises:

an adjustable guide rail coupled to the frame.

11. An automatic packaging apparatus as defined in claim 9 wherein said input conveyor further comprises:

an empty carton stop coupled to the guide rail.

12. An automatic packaging apparatus as defined in claim 11 wherein said input conveyor system further comprises:

a limit switch coupled to the frame and positioned for contact by the container, wherein upon contact the transfer device is actuated.

13. An automatic packaging apparatus as defined in claim 12 wherein the input conveyor drive train comprises:

a plurality of drive rollers coupled to the frame and positioned adjacent to and below the rollers;

a drive band positioned on the plurality of drive rollers, in a manner to frictionally engage said rollers; and drive means coupled to said drive train wherein the drive means imparts motion to the drive band which in turn imparts rotary motion to the drive wheels and rollers that are frictionally engaged by the drive band.

14. An automatic packaging apparatus as defined in claim 13 wherein said output conveyor system comprises:

a frame adjacent to and coupled to the input conveyor system frame; and a plurality of output conveyor rollers positioned between and coupled to the frame in a manner enabling said rollers to rotate.

15. An automatic packaging apparatus as defined in claim 14 wherein said output conveyor system further comprises:

output conveyor drive train coupled to the output conveyor frame and positioned adjacent to and frictionally engaging the output conveyor rollers wherein the output conveyor drive train will impart a rotary motion to the output conveyor rollers.

16. An automatic packaging apparatus as defined in claim 15 wherein the horizontal feeder system further comprises:

a plurality of conveyor ribbons coupled to the drive roller and guide roller, wherein motion is imparted to said plurality of ribbons via the drive roller conveying product deposited on said ribbons to the vertical flite conveyor.

17. An automatic packaging apparatus as defined in claim 16 wherein the horizontal feeder system further comprises:

an electric eye coupled to said horizontal conveyor system, wherein said electric eye is part of a counter for recording the quantity of product passing on said horizontal feeder.

18. An automatic packaging apparatus as defined in claim 17 wherein said horizontal feeder system further comprises:

a pair of guide plates coupled to the side plates and positioned above said conveyor ribbons to enable the product deposited onto said conveyor ribbons to pass under the electric eye.

19. An automatic packaging apparatus as defined in claim 18 wherein said means for enabling the trap door on the hopper is an air cylinder.

20. An automatic packaging apparatus as defined in claim 19 wherein the vertical flite conveyor system further comprises driving means for imparting rotary motion to the drive roller of the vertical flite conveyor system.

21. An automatic packaging apparatus as defined in claim 20 wherein said vertical flite conveyor further comprises:

disconnect means coupled to the drive roller for disengaging the drive roller of the vertical flite conveyor from the drive means.

22. An automatic packaging system as defined in claim 21 wherein said disconnect means is an electrically activated clutch.

23. An automatic packaging apparatus as defined in claim 22 wherein the input conveyor system further comprises:

an electric eye device attached to the outside frame wherein the breaking of the beam generated by said electric eye will initiate a signal to the full carton stop enabling it to rise above the input conveyor system rollers and stop empty container under the hopper and simultaneously enable the empty carton stop to inhibit the movement of any additional containers to the under hopper.

24. An automatic packaging system as defined in claim 23, wherein said impact mechanism comprises:

a pair of plates coupled to the input conveyor frame and positioned parallel to each other; said plates being separated a distance to enable the positioning of a container therebetween; and means coupled to said plates enabling them to alternately create an impact upon a container positioned between said plates.

25. An automatic packaging apparatus as defined in claim 24 wherein the transfer mechanism comprises:

a plow bar being positioned parallel to the guide rail and above and perpendicular to the input conveyor rollers;

a connecting rod coupled to the plow bar and positioned between a pair of the plurality of input conveyor rollers; and actuating means coupled to the connecting rod and input conveyor frame enabling the plow bar to push a container from the input conveyor system to the output conveyor system.

26. An automatic packaging apparatus as defined in claim 25 wherein the actuating means coupled to the connecting rod and the input conveyor frame is an air cylinder, which when activated by the limit switch enables the plow bar to move in an arc, thereby transferring a container adjacent the plow bar to the output conveyor system.

27. An automatic packaging apparatus as defined in claim 26 wherein the empty carton stop comprises:

a moveable plate coupled to the guide rail; and means coupled to the moveable plate and guide rail enabling said plate to move in a perpendicular direction to the input conveyor rollers wherein said plate will inhibit containers from being conveyed further along said rollers.

28. An automatic packaging apparatus as defined in claim 27 wherein said means coupled to the moveable plate is an air cylinder.

* * * * *

UNITED STATES PATENT OFFICE

CERTIFICATE OF CORRECTION

Patent No. 4,027,458 Dated June 7, 1977

Inventor(s) James A. Goodman

It is certified that error appears in the above-identified patent and that said Letters Patent are hereby corrected as shown below:

Column 2, line 65, "emmbodied" should read -- embodied --.

Column 3, line 37, "numberal" should read -- numeral --.

Column 4, line 53, "granualar" should read -- granular --.

Column 6, line 18, "send" should read -- sense --.

Column 7, line 47, "18" should read -- 118 --.

Column 10, line 1, "simultaneously" should read -- simultaneous--.

Column 11, line 62, "sides" should read -- side --.

Column 12, line 14, "." should read -- ; --.

Column 12, line 40, "9" should read -- 10 --.

Column 13, line 39, after "comprises" insert -- : --.

Column 13, line 49, "system" should read -- apparatus --.

CERTIFICATE OF CORRECTION

Patent No. 4,027,458 Dated June 7, 1977

Inventor(s) James A. Goodman

It is certified that error appears in the above-identified patent and that said Letters Patent are hereby corrected as shown below:

Column 14, line 12, "system" should read -- apparatus --.

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*